US011952697B2

(12) United States Patent
Choi et al.

(10) Patent No.: US 11,952,697 B2
(45) Date of Patent: Apr. 9, 2024

(54) METHOD OF CONTROLLING WASHING MACHINE

(71) Applicant: LG Electronics Inc., Seoul (KR)

(72) Inventors: Dongkil Choi, Seoul (KR); Sunjung Kim, Seoul (KR); Hyemin Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/624,704

(22) PCT Filed: Jul. 3, 2020

(86) PCT No.: PCT/KR2020/008706
§ 371 (c)(1),
(2) Date: Jan. 4, 2022

(87) PCT Pub. No.: WO2021/002720
PCT Pub. Date: Jan. 7, 2021

(65) Prior Publication Data

US 2022/0259786 A1 Aug. 18, 2022

(30) Foreign Application Priority Data

Jul. 4, 2019 (KR) ..... 10-2019-0080606

(51) Int. Cl.
*D06F 33/43* (2020.01)
*D06F 33/34* (2020.01)
(Continued)

(52) U.S. Cl.
CPC ..... *D06F 33/40* (2020.02); *D06F 33/34* (2020.02); *D06F 39/04* (2013.01);
(Continued)

(58) Field of Classification Search
CPC ..... D06F 33/34; D06F 33/36; D06F 33/38; D06F 33/40; D06F 33/42; D06F 33/43;
(Continued)

(56) References Cited

U.S. PATENT DOCUMENTS 9,062,407 B2 * 6/2015 Kim ..... D06F 33/48

FOREIGN PATENT DOCUMENTS

EP 1681384 7/2006
KR 10-2006-0082689 7/2006
(Continued)

OTHER PUBLICATIONS

Machine Translation of Choi et al., WO-2017135602-A1, Aug. 2018. (Year: 2018).*
(Continued)

*Primary Examiner* — David G Cormier
(74) *Attorney, Agent, or Firm* — Fish & Richardson P.C.

(57) ABSTRACT

A method for controlling a washing machine supplying water to at least a portion of the drum in the tub, performing a first operation in which the water contained in the tub is heated by operating a heater and the drum is rotated at a first set speed, draining the tub, supplying water to submerge at least a portion of the drum in the tub, and performing a second operation for heating the water in the tub by the heater and rotating the drum. The second operation includes rotating the drum at a second set speed lower than the first set speed, and repeating a first drum cleaning operation in which the drum is rotated at a third set speed lower than the second set speed, and a second drum cleaning operation in which the drum is rotated at a fourth set speed lower than the third set speed.

15 Claims, 4 Drawing Sheets

(51) Int. Cl.

| | |
|---|---|
| ***D06F 33/40*** | (2020.01) |
| ***D06F 39/04*** | (2006.01) |
| *D06F 105/02* | (2020.01) |
| *D06F 105/10* | (2020.01) |
| *D06F 105/48* | (2020.01) |

(52) U.S. Cl.
CPC ..... *D06F 2105/02* (2020.02); *D06F 2105/10* (2020.02); *D06F 2105/48* (2020.02)

(58) Field of Classification Search
CPC ..... D06F 33/46; D06F 33/54; D06F 33/56; D06F 33/58; D06F 33/60; D06F 33/62; D06F 33/69; D06F 33/72; D06F 34/24; D06F 35/005; D06F 35/008; D06F 2105/02; D06F 2105/08; D06F 2105/10; D06F 2105/48

See application file for complete search history.

(56) References Cited

FOREIGN PATENT DOCUMENTS

| | | | | |
|---|---|---|---|---|
| KR | 10-2006-0085962 | | 7/2006 | |
| KR | 10-2006-0094694 | | 8/2006 | |
| KR | 10-0624719 | | 9/2006 | |
| KR | 10-2007-0050583 | | 5/2007 | |
| KR | 10-2010-0043664 | | 4/2010 | |
| KR | 10-2011-0031764 | | 3/2011 | |
| KR | 10-2017-0099150 | | 8/2017 | |
| WO | WO-2017135602 | A1 * | 8/2017 | ..... D06F 21/00 |
| WO | WO 2018/164548 | | 9/2018 | |

OTHER PUBLICATIONS

International Search Report in International Appln. No. PCT/KR2020/008706, dated Oct. 21, 2020, 6 pages (with English translation).
Office Action in Korean Appln. No. 10-2019-0080606, dated Oct. 23, 2023, 12 pages (with English translation).
Extended European Search Report in European Appln. No. 20835499.3, dated Jun. 19, 2023, 9 pages.

* cited by examiner

METHOD OF CONTROLLING WASHING MACHINE

CROSS-REFERENCE TO RELATED APPLICATIONS

This application is a National Stage application under 35 U.S.C. § 371 of International Application No. PCT/KR2020/008706, filed on Jul. 3, 2020, which claims the benefit of Korean Patent Application No. 10-2019-0080606, filed on Jul. 4, 2019. The disclosures of the prior applications are incorporated by reference in their entirety.

TECHNICAL FIELD

The present disclosure relates to a washing machine with a circulation nozzle and a control method thereof.

BACKGROUND ART

Generally, a washing machine has on a front surface of a casing an input port for putting laundry into a drum which is rotatably installed in the casing, and has a door for opening and closing the input port. A portion of a rear surface of the door is in close contact with the front surface of the casing, and another portion of the rear surface protrudes rearwards to be inserted into the input port, thus preventing laundry or water contained in the drum from leaking to an outside through the input port.

Korean Patent Laid-Open Publication KR 10-2017-0099150 has disclosed a washing machine including a wash reinforcement nozzle which sprays wash water into a drum, and a door wash nozzle which sprays wash water onto a door.

This washing machine is problematic in that a spray range through the wash reinforcement nozzle is restricted, so an area where washing cannot be performed occurs on an inner surface of the drum, and water sprayed from the wash reinforcement nozzle reaches only an interior of the drum, so it is difficult to wash an outer surface of the drum or an inner surface of a tub surrounding the drum.

DISCLOSURE

Technical Problem

First, an objective of the present disclosure is to provide a method of controlling a washing machine, which is improved in drum cleaning capability.

Second, an objective of the present disclosure is to provide a method of controlling a washing machine, which can cleanly wash an outer surface of a drum.

Third, an objective of the present disclosure is to provide a method of controlling a washing machine, which can cleanly wash an inner surface of a tub.

Technical Solution

The present disclosure is directed to a method of controlling a washing machine configured such that a drum having on a front surface thereof an inlet through which laundry is put is rotatably provided in a tub containing water. The control method includes (a) a step of supplying water to submerge at least a portion of the drum in the tub; (b) a step of performing at least once an operation in which the water contained in the tub is heated by operating a heater and the drum is rotated at a first set speed; (c) a step of draining the tub; (d) a step of supplying water to submerge at least a portion of the drum in the tub; and (e) a step of performing at least once an operation in which the water contained in the tub is heated by operating the heater and the drum is rotated.

The step (e) includes a step of rotating at least once the drum at a second set speed which is lower than the first set speed; and a step of repeating a first drum cleaning operation in which the drum is rotated at least once at a third set speed lower than the second set speed, and a second drum cleaning operation in which the drum is rotated at least once at a fourth set speed lower than the third set speed.

The step (b) may further include a step of feeding steam into the drum.

A water supply amount at the step (d) may be greater than a water supply amount at the step (a).

The first set speed may range from 195 to 205 rpm.

The second set speed may range from 175 to 185 rpm.

The third set speed may range from 145 to 155 rpm.

The step (e) may further include a step of repeating a third drum cleaning operation in which the drum is rotated at least once at the second set speed, and a fourth drum cleaning operation in which the drum is rotated at least once at the third set speed.

The method may further include a step of draining the tub after the step (e); and a step of feeding water into the drum through a direct water nozzle while rotating the drum at a speed higher than the first set speed.

The operation of the heater at the step (b) may be controlled such that a temperature of water contained in the tub reaches a first set temperature defined between 55° C. and 70° C.

The operation of the heater at the step (e) may be controlled such that the temperature of water contained in the tub reaches a second set temperature higher than the first set temperature.

The fourth set speed may range from 40 to 50 rpm.

Advantageous Effects

The control method of the washing machine according to the present disclosure is advantageous in that a heater is operated to sterilize water in a tub, thus providing good hygiene, and the rotating speed of a drum is controlled in this process to generate a water current moved upwards in a tub by friction with the drum, thus allowing both an outer surface of the drum and an inner surface of the tub to be evenly cleaned.

MODE FOR DISCLOSURE

Figure 1:
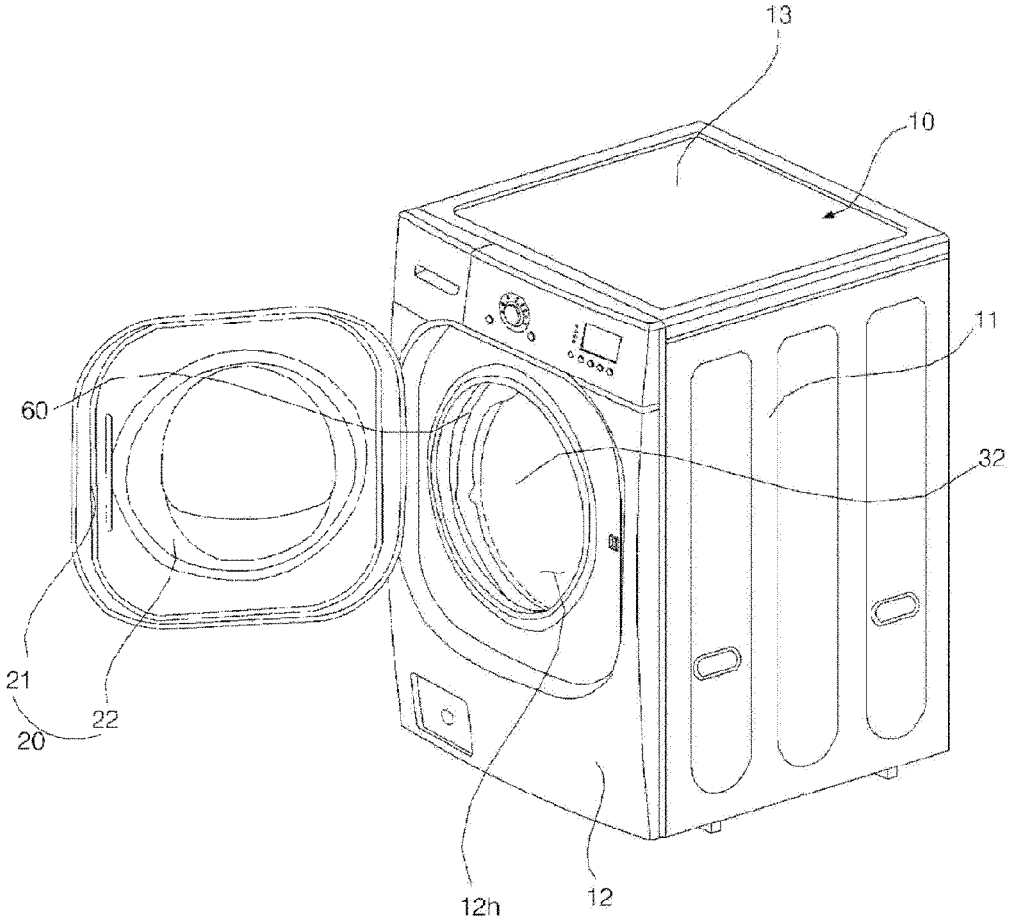
FIG. 1 is a perspective view of a washing machine according to an embodiment of the present disclosure.

The above and other objectives, features, and advantages of the present disclosure will be more clearly understood from the following detailed description when taken in conjunction with the accompanying drawings. However, the present disclosure may be embodied in other aspects without being limited to the embodiments disclosed below. The embodiments are provided to make the present disclosure complete and to sufficiently convey the scope of the present disclosure to those skilled in the art without departing from the scope of the claims. In the present specification, it should be noted that the same reference numerals are used to denote the same components throughout different drawings.

Figure 2:
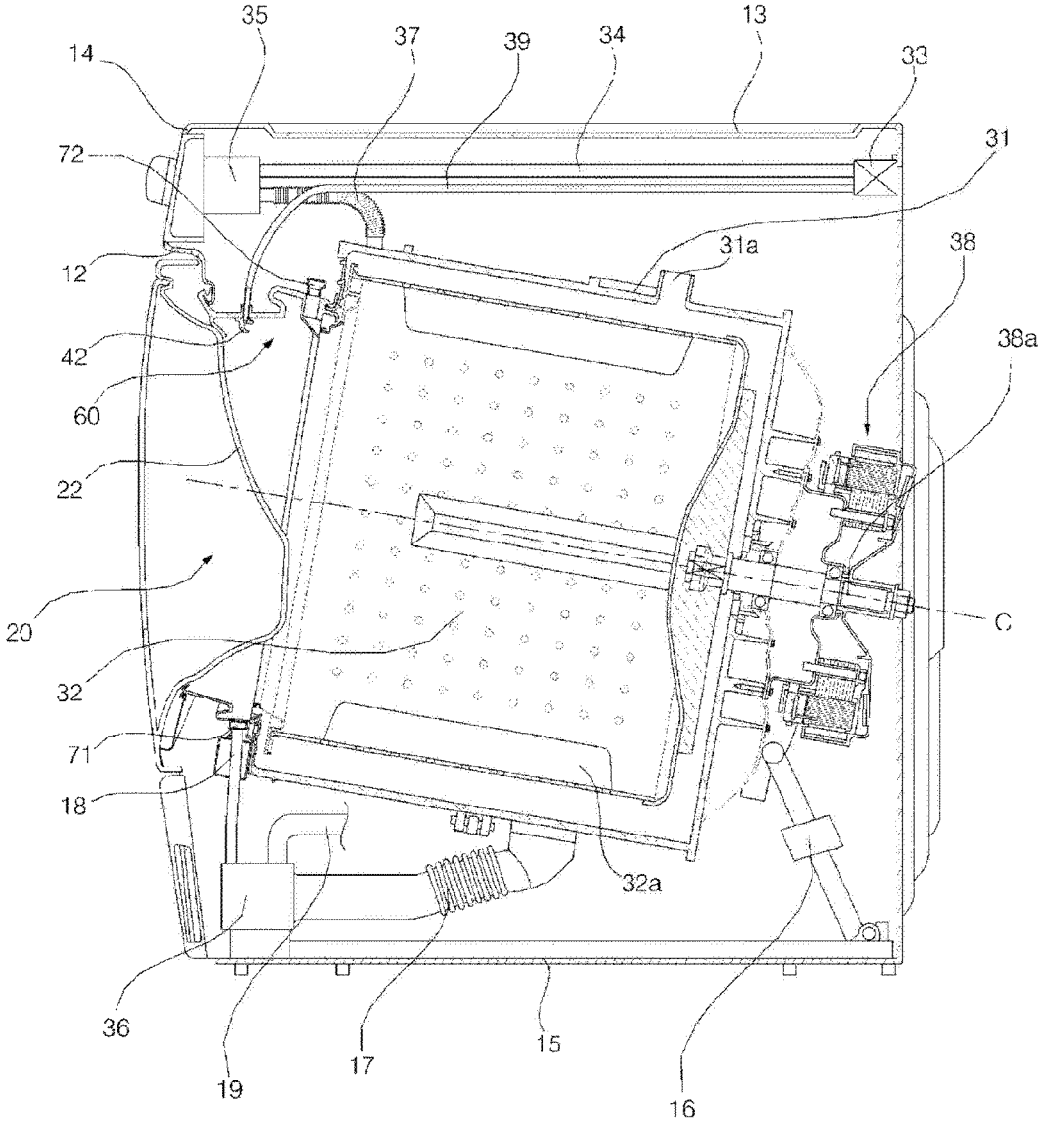
FIG. 2 is a side sectional view of the washing machine illustrated in FIG. 1.
Figure 3:
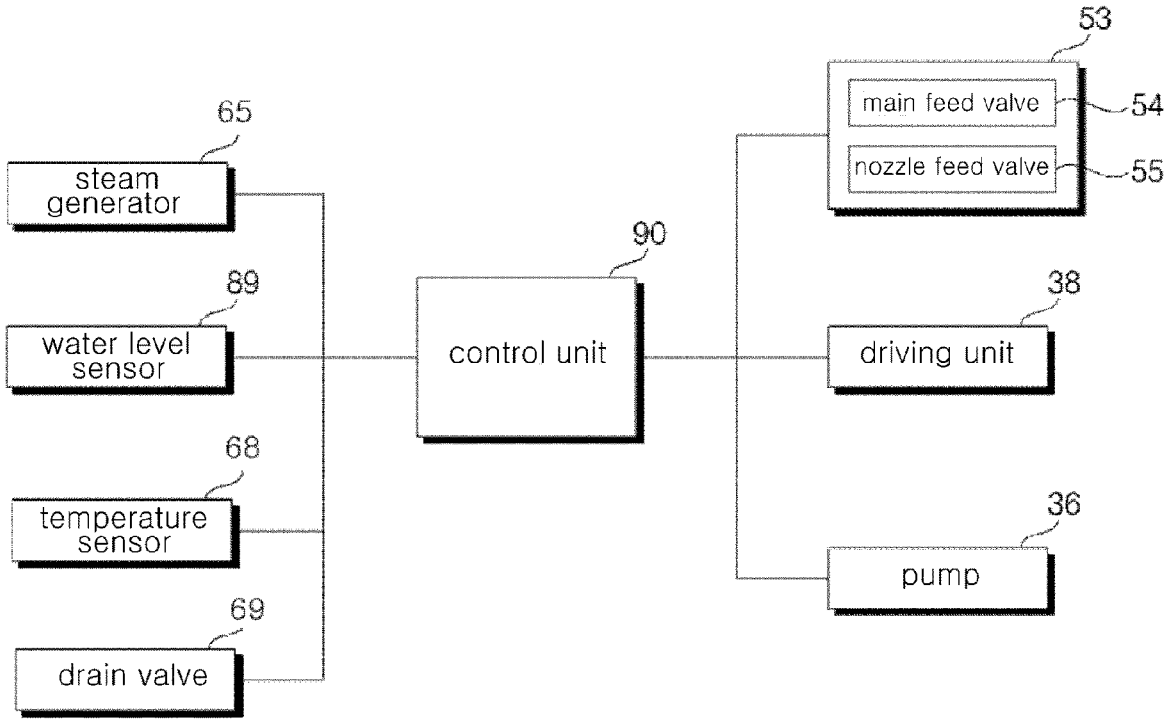
FIG. 3 is a block diagram illustrating a control relationship between main components of the washing machine according to an embodiment of the present disclosure.
Figure 4:
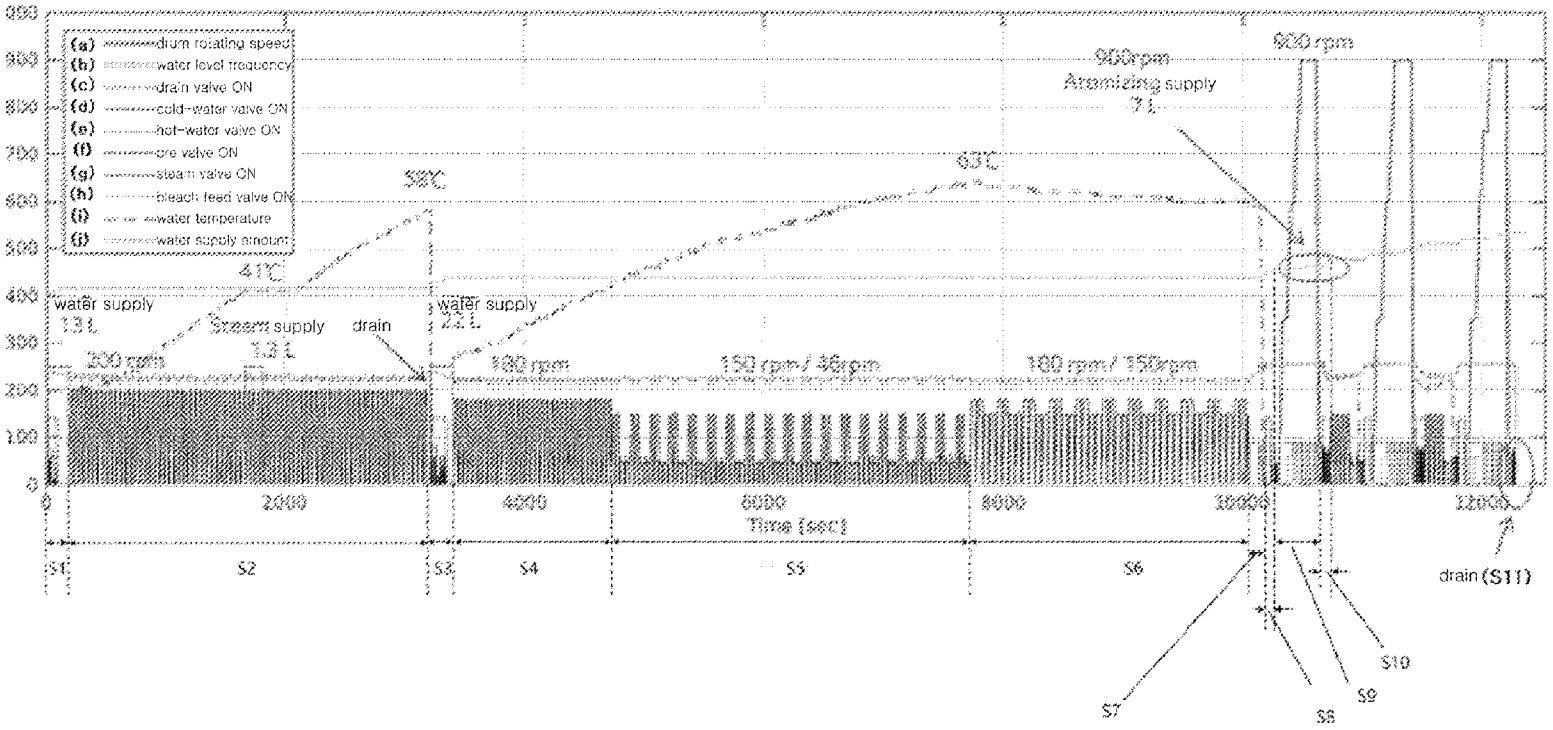
FIG. 4 is a graph illustrating a method of controlling a washing machine according to an embodiment of the present disclosure.

FIG. 1 is a perspective view of a washing machine according to an embodiment of the present disclosure. FIG. 2 is a side sectional view of the washing machine illustrated in FIG. 1. FIG. 3 is a block diagram illustrating a control relationship between main components of the washing machine according to an embodiment of the present disclosure. FIG. 4 is a graph illustrating a method of controlling a washing machine according to an embodiment of the present disclosure.

Referring to FIGS. 1 to 3, a casing 10 defines the appearance of the washing machine, and an input port 12*h* is formed in a front surface of the casing to put laundry therein. The casing 10 may include a cabinet 11 which is opened at a front surface thereof and has a left surface, a right surface, and a rear surface, and a front panel 12 which is coupled to the open front surface of the cabinet 11, with the input port 12*h* being formed thereon.

The lower surface and the upper surface of the cabinet 11 may be opened, and a horizontal base 15 may be coupled to the lower surface to support the washing machine. The casing 10 may further include a top plate 13 which covers the open upper surface of the cabinet 11, and a control panel 14 which is disposed on an upper portion of the front panel 12.

A tub 31 may be disposed in the casing 10 to contain water therein. An inlet is formed in the front surface of the tub 31 to allow laundry to be put therein. The cabinet 11 and the tub 31 are connected by an annular gasket 60, so a passage for putting or taking laundry into or out from the casing is formed in a section extending from the inlet of the tub 31 to the input port 12*h*.

The door 20 for opening or closing the input port 12*h* may be rotatably coupled to the casing 10. The door 20 may include a door frame 21 which is opened at a central portion thereof and is rotatably coupled to the front panel 12, and a transparent window 22 which is installed in the open central portion of the door frame 21. The window 22 may have a rearwardly convex shape, so at least a portion of the window may be located in an area surrounded by an inner circumferential surface of the gasket 60.

The control panel 14 may include a display unit 14*a* which displays the operating state of the washing machine, and an input unit 14*b* which receives various control commands about the operation of the washing machine from a user.

The gasket 60 is formed such that each of front and rear ends has an annular shape, and has the shape of a tube extending from the front end to the rear end. The front end of the gasket 60 is secured to the casing 10, and the rear end thereof is secured to the circumference of the inlet of the tub 31. The gasket 60 may be made of a flexible or elastic material. The gasket 60 may be made of natural rubber or synthetic resin. In a state where the door 20 is closed, the front end of the gasket 60 is in close contact with the rear surface of the door 20, thus preventing water in the tub 31 from leaking through the inlet of the gasket 60.

Hereinafter, a portion defining the inner side of the tubular gasket 60 is referred to as an inner circumference (or inner circumferential surface) of the gasket 60, and an opposite portion is referred to as an outer circumference (or outer surface) of the gasket 60.

A drum 32 may be rotatably provided in the tub 31. The drum 32 holds laundry therein, is disposed such that an inlet for putting laundry is located on a front surface, and rotates about a horizontal axis C. In this regard, the term "horizontal" is not a term used in a mathematically strict sense. That is, although the axis C is inclined at a predetermined angle with respect to a horizontal as in an embodiment, it may be said to be substantially horizontal when the axis is closer to the horizontal rather than vertical. Multiple holes (not shown) are formed in the drum 32 to introduce water contained in the tub 31 into the drum 32.

A plurality of lifters 32*a* may be provided on the inner surface of the drum 32. The plurality of lifters 32*a* may be disposed at a predetermined angle to the center of the drum 32. When the drum 32 rotates, the laundry is repeatedly lifted and dropped by the lifters 32*a*.

A driving unit 38 is further provided to rotate the drum 32. A driving shaft 38*a* rotated by the driving unit 38 may be coupled to the drum 32 via the rear surface of the tub 31.

Preferably, the driving unit 38 includes a direct connected washing motor, and the washing motor may include a stator which is secured to the rear of the tub 31, and a rotor which is rotated by a magnetic force acting between the rotor and the stator. The driving shaft 38*a* may be rotated integrally with the rotor.

The tub 31 may be supported by a damper 16 installed at the base 15. The vibration of the tub 31 caused by the rotation of the drum 32 is attenuated by the damper 16. Although not shown in the drawings, according to an embodiment, a hanger (e.g. spring) may be further provided to hang the tub 31 to the interior of the casing 10.

The washing machine may include at least one water supply hose (not shown) which guides water fed from an external water source such as a faucet, and a water supply unit 33 which controls to supply water fed through at least one water supply hose to at least one water supply pipe 34.

A dispenser 35 may be provided to feed additives such as detergent or a fabric softener into the tub 31 or the drum 32. The additives may be classified according to the type and then be accommodated in the dispenser 35. The dispenser 35 may include a detergent compartment (not shown) which accommodates the detergent, and a softener compartment (not shown) which accommodates the fabric softener.

At least one water supply pipe 34 or 39 may be provided to guide water supplied through the water supply unit 33. The water supply unit 33 may include at least one feed valve to control at least one water supply pipe 34 or 39.

At least one water supply pipe 34 or 39 may include a main water supply pipe 34 which guides water supplied through the water supply hose to the dispenser 35, and a direct water supply pipe 39 which guides water supplied through the water supply hose to a direct water nozzle 42.

The at least one feed valve may include at least one main feed valve 54 which controls the main water supply pipe 34, and a nozzle feed valve 55 which controls the direct water supply pipe 39.

Although not shown in the drawings, the main water supply pipe 34 may include a cold-water supply pipe which supplies cold water, a hot-water supply pipe which supplies hot water, a pre-water supply pipe which supplies cold water for pre-wash, and/or a bleach supply pipe which supplies water to a compartment containing bleach.

At least one main feed valve 54 may include a cold-water valve which controls the cold-water supply pipe, a hot-water valve which controls the hot-water supply pipe, and a pre valve which controls the pre-water supply pipe.

Further, the washing machine may include a steam generator 65 for feeding steam into the drum 32, and a steam valve for controlling a steam supply pipe which guides water fed to the steam generator 65.

The above-described feed valves are controlled by a control unit 90. Unless otherwise specified, a "control" for various electrically operated components is defined as being made by the control unit 90.

The gasket 60 may be provided with the direct water nozzle 42 which sprays water into the drum 32. Water supplied through the water supply unit 33 is guided to the direct water nozzle 42 by the direct-water supply pipe 39. The direct water nozzle 42 may be a swirl nozzle or a spray nozzle, but is not necessarily limited thereto.

Water discharged from the dispenser 35 is supplied through the water supply bellows 37 to the tub 31. A water supply port (not shown) connected to the water supply bellows 37 may be formed in a side surface of the tub 31. The water supply bellows 37 may be connected to the tub 31, so water discharged from the dispenser 35 is primarily supplied to the tub 31. However, some water dropped to the surface of the drum 32 may flow through the hole 32*h* into the drum 32. As the level of water in the tub 31 is increased due to water supply, the drum 32 is submerged in the water. Even in this case, water is fed through the hole 32*h* into the drum 32. In both of these cases, it will be defined as a case in which water is fed into the drum 32.

A drain port may be formed in the tub 31 to discharge water, and a drain bellows 17 may be connected to the drain port. A pump 36 may be provided to pump water discharged from the tub 31 through the drain bellows 17. A drain valve 69 may be further provided to control the drain bellows 17. Water discharged through the drain bellows 17 is discharged through a drain pipe (not shown) to an outside of the washing machine.

The pump 36 may selectively perform a drain function of sending water discharged through the drain bellows 17 to the drain pipe, and a circulation function of sending water to a circulation pipe 18. A number of techniques for selectively performing the drain function and the circulation function using a single pump are already well known, so a detailed description thereof will be omitted herein.

However, without being limited thereto, a circulation pump which is connected to the circulation pipe 18 to circulate water and a drain pump which is connected to the drain pipe to drain water may be separately provided.

The gasket 60 is provided with a circulation nozzle 72 which sprays water (circulating water) into the drum 32. Water discharged from the pump 36 is supplied through the circulation pipe 18 to the circulation nozzle 72.

The circulation nozzle 72 may be disposed on the gasket 60. Preferably, the circulation nozzle 72 is formed integrally with the gasket 60. A plurality of circulation nozzles 72 may be formed on the inner circumference of the gasket 60.

A nozzle feed pipe 71 may include a tubular duct (not shown) extending along the outer circumference of the gasket 60, and a plurality of discharge ports (not shown) protruding from the duct and passing through the gasket 60. The plurality of discharge ports may supply circulating water to the plurality of circulation nozzles 72, respectively. On the other hand, a heater 66 may be further provided to heat water contained in the tub 31. The heater 66 may be disposed in the tub 31, and be disposed under the drum 32 so as not to interfere with the drum 32.

FIG. 4 is a graph illustrating a method of controlling a washing machine according to an embodiment of the present disclosure. To be more specific, the graph of FIG. 4 shows the rotating speed a of the drum, a water level frequency b (the higher the water level is, the lower a water level frequency value is) indicating the level of water contained in the tub 31, an operation c of the drain valve 69, an operation d of the cold-water valve, an operation e of the hot-water valve, an operation f of the pre valve, an operation g of the steam valve, an operation h of the bleach feed valve, a temperature i of water contained in the tub, and a total amount j of water supplied to the tub.

Referring to FIG. 4, the method of controlling the washing machine according to an embodiment of the present disclosure includes a step S1 of supplying water to submerge at least a portion of the drum 32 into the tub 31, and a step S2 of performing at least once an operation in which water contained in the tub 31 is heated by operating the heater 66 and the drum 32 is rotated at a first set speed.

At step S1, at least one main feed valve 54 is opened to supply water. The control unit 90 may shut off the main feed valve 54, if it is determined that water has been supplied by a first set water supply amount (e.g., 13L) based on the water level frequency sensed by a water level sensor 89. In a state where water is supplied by the first set water supply amount, the level of water in the tub 31 is higher than a level at which the lowermost end of the drum 32 contacts.

The water supply is stopped, and step S2 is performed. At step S2, the heater 66 is operated to heat water contained in the tub 31. At this time, an operation in which the drum 32 is rotated at the first set speed for a predetermined time and then is stopped is repeated several times. The first set speed may range from 195 to 205 rpm, and preferably be 200 rpm.

Water contained in the tub 31 moves upwards along the inner surface of the tub 31 by friction action with the drum 32. At this time, the water current is wound in the rotating direction of the drum 32, and thus, the outer surface of the drum 32 and the inner surface of the tub 31 are washed by the water current.

At step S2, water may be supplied through the steam generator 65 while the drum 32 is repeatedly rotated and stopped. The steam valve is turned on to supply water to the steam generator 65, and steam generated by the steam generator 65 is sprayed into the drum 32. The amount of water supplied by the steam generator 65 may be approximately 1.3 L, but is not necessarily limited thereto.

At step S2, the heater 66 may be controlled such that the temperature of water contained in the tub 31 reaches the first set temperature. A temperature sensor 68 may be provided to sense the temperature of water in the tub 31, and the control unit 90 may control the operation of the heater 66 based on the sensing value of the temperature sensor.

The first set temperature may be a value defined between 55° C. to 70° C. The drum 32 and the tub 31 may be sterilized by hot water which is heated by the heater 66. Particularly in this temperature range, most bacteria are killed, so hygiene is improved. In an embodiment, the first set temperature is 58° C., but is not necessarily limited thereto.

The operation of the heater 66 is stopped, and water contained in the tub 31 is drained (cf. portion indicated by "drain" in FIG. 4). The drain valve 69 is opened, and the pump 36 is operated, thus draining water.

Subsequently, water is fed again into the tub 31. As in step S1, at least a portion of the drum 32 is submerged in water contained in the tub 31 (S3).

At step S3, at least one main feed valve 54 is opened to supply water. The control unit 90 may shut off the main feed valve 54, if it is determined that water has been supplied by a second set water supply amount (e.g., 22L) based on the water level frequency sensed by the water level sensor 89. In a state where water is supplied by the second set water supply amount, the level of water in the tub 31 is higher than a level at which the lowermost end of the drum 32 contacts. The second set water supply amount may be greater than the first set water supply amount at step S1.

The water supply is stopped, and step S4 is performed. At step S4, the heater 66 is operated to heat water contained in the tub 31. At this time, an operation in which the drum 32 is rotated for a predetermined time and then is stopped is repeated several times.

Step S4 may include a step of rotating the drum 32 at a second set speed at least once. The second set speed may be lower than the first set speed, may range from 175 to 185 rpm, and preferably be 180 rpm. At step S4, an operation in which the drum 32 is rotated at the second set speed and then is stopped may be repeated several times.

At step S5 performed subsequent to step S4, a first drum cleaning operation and a second drum cleaning operation may be repeatedly performed.

The first drum cleaning operation is to rotate the drum 32 at a third set speed lower than the second set speed at least once. The third set speed may range from 145 to 155 rpm, and preferably be 150 rpm. An operation in which the drum 32 is rotated at the third set speed for a predetermined time and then is stopped may be repeated several times.

The second drum cleaning operation is to rotate the drum 32 at a fourth set speed lower than the third set speed at least once. The fourth set speed may range from 40 to 50 rpm, and preferably be 46 rpm. An operation in which the drum 32 is rotated at the fourth set speed for a predetermined time and then is stopped may be repeated several times.

On the other hand, the operation of the heater 66 may be controlled such that the water temperature in the tub 31 reaches the preset second set temperature while step S5 is performed. Here, the second set temperature may be defined between 55° C. and 70° C. similarly to the first set temperature. Preferably, the second set temperature may be higher than the first set temperature. In an embodiment, the second set temperature is 63° C., but is not necessarily limited thereto.

Step S6 is performed subsequent to step S5. Step S6 is a step of repeatedly performing a third drum cleaning operation of rotating the drum 32 at the second set speed at least once, and a fourth drum cleaning operation of rotating the drum 32 at the third set speed at least once. The operation of the heater 66 may be controlled such that the water temperature in the tub 31 reaches the second set temperature while step S6 is performed.

Step S7 is performed to drain the tub 31 subsequent to step S6. At step S7, the drain valve 69 is opened, and the pump 36 is operated to discharge water.

After stopping to discharge water, a water supply step S8 is performed. At least one main feed valve 54 is opened to supply water.

Thereafter, step S9 of adding water to the drum 32 through the direct water nozzle 42 is performed while the drum 32 is rotated at high speed. At this time, the rotating speed of the drum 32 is higher than the first set speed, and is increased up to preferably 900 rpm. While water sprayed with strong water pressure through the direct water nozzle 42 is repelled by the drum 32, the inner surface of the drum 32 may be powerfully washed. In addition, water scattered to an outside of the drum 32 powerfully washes the inner surface of the tub 31 by rotating the drum 32. While step S9 is performed, a drain step S10 may be performed.

Step S9 and step S10 may be repeated one or more times. Subsequently, step S11 of discharging residual water may be further performed while the drum 32 is rotated at low speed of 60 rpm or less.

On the other hand, the washing machine may include an input unit (not shown) to allow a user to select and input a drum cleaning course. The above-described control method may be performed when the drum cleaning course is selected through the input unit.

Accordingly, the detailed description should not be construed as being limitative from all aspects, but should be construed as being illustrative. The scope of the present disclosure should be determined by reasonable analysis of the attached claims, and all changes within the equivalent range of the present disclosure are included in the scope of the present disclosure.

The invention claimed is:

1. A method for controlling a washing machine, the washing machine including a tub configured to receive water, a drum having an inlet defined on a front surface thereof and configured to receive laundry, the method comprising:

supplying a first amount of water to submerge at least a first portion of the drum in the tub;

performing a first operation for heating water in the tub by a heater while rotating the drum at a first set speed;

based on performing the first operation, of draining water from the tub;

based on draining water from the tub, of supplying a second amount of water to submerge at least a second portion of the drum in the tub, the second amount being greater than the first amount; and based on supplying the second amount of water to the tub, performing a second operation for heating water in the tub by the heater while rotating the drum at a second set speed that is less than the first set speed.

2. The method of claim 1, wherein the second operation further comprises:

supplying steam into the drum.

3. The method of claim 1, wherein the first set speed ranges from 195 to 205 revolutions per minute (rpm).

4. The method of claim 3, wherein the second set speed ranges from 175 to 185 rpm.

5. The method of claim 1, further comprising:

draining the tub after performing the second operation; and supplying water into the drum through a direct water nozzle while rotating the drum at a speed higher than the first set speed.

6. The method of claim 1, wherein the first operation comprises controlling the heater to increase a temperature of water in the tub to a first set temperature between 55° C. and 70° C.

7. The method of claim 6, wherein the second operation comprises controlling the heater to increase the temperature of water in the tub to a second set temperature higher than the first set temperature.

8. The method of claim 1, further comprising:

rotating the drum at a third set speed that is less than the second set speed;

rotating the drum at a fourth set speed that is less than the third set speed; and alternating (i) rotation of the drum at the third set speed and (ii) rotation of the drum at the fourth set speed.

9. The method of claim 8, wherein the first set speed ranges from 195 to 205 rpm.

10. The method of claim 9, wherein the second set speed ranges from 175 to 185 rpm.

11. The method of claim 10, wherein the third set speed ranges from 145 to 155 rpm.

12. The method of claim 11, wherein the fourth set speed ranges from 40 to 50 rpm.

13. The method of claim 8, further comprising:

alternating (i) rotation of the drum at the second set speed and (ii) rotation of the drum at the third set speed.

14. The method of claim 1, further comprising:

rotating the drum at a third set speed that is less than the second set speed; and alternating (i) rotation of the drum at the second set speed and (ii) rotation of the drum at the third set speed.

15. The method of claim 14, wherein the first set speed ranges from 195 to 205 rpm, the second set speed ranges from 175 to 185 rpm, and the third set speed ranges from 145 to 155 rpm.

* * * * *